US006812418B2

(12) United States Patent
Kramski et al.

(10) Patent No.: US 6,812,418 B2
(45) Date of Patent: Nov. 2, 2004

(54) FASTENING OF A CONTACT ELEMENT

(75) Inventors: Wiestaw Kramski, Birkenfeld (DE); Joachim Schweizer, Birkenfeld-Gräfenhausen (DE); Ewald Fretz, Gondelsheim (DE)

(73) Assignee: Kramski GmbH, Pforzheim (DE)

( * ) Notice: Subject to any disclaimer, the term of this patent is extended or adjusted under 35 U.S.C. 154(b) by 56 days.

(21) Appl. No.: 10/417,826

(22) Filed: Apr. 17, 2003

(65) Prior Publication Data

US 2003/0196881 A1 Oct. 23, 2003

(51) Int. Cl.[7] ..... H01H 1/24
(52) U.S. Cl. ..... 200/238; 200/245
(58) Field of Search ..... 200/238, 239, 200/245, 246, 252, 257, 271, 275, 282, 283, 284

(56) References Cited

U.S. PATENT DOCUMENTS

| | | | | |
|---|---|---|---|---|
| 2,700,087 A | | 1/1955 | Stevens | |
| 3,555,210 A | * | 1/1971 | Richardson | 200/11 D |
| 3,592,996 A | | 7/1971 | Sayer | |
| 4,025,143 A | | 5/1977 | Rozmus | |
| 4,414,735 A | * | 11/1983 | Buisson | 29/879 |
| 5,057,746 A | * | 10/1991 | Kleven et al. | 315/106 |
| 5,315,758 A | | 5/1994 | Ono et al. | |
| 6,041,497 A | * | 3/2000 | Nakagawa | 29/882 |
| 6,143,998 A | * | 11/2000 | Mattes | 200/275 |

FOREIGN PATENT DOCUMENTS

| | | |
|---|---|---|
| DE | 200 822 C | 7/1908 |
| DE | 29 47 811 A1 | 6/1981 |
| JP | 48 063960 A | 9/1973 |

* cited by examiner

*Primary Examiner*—Michael A. Friedhofer
(74) *Attorney, Agent, or Firm*—Volpe and Koenig, P.C.

(57) ABSTRACT

A contact fastened in a contact element by opposite overlaps is provided. The contact is subsequently connected to the contact element with a laser or a special stamping.

16 Claims, 3 Drawing Sheets

FASTENING OF A CONTACT ELEMENT

BACKGROUND

The invention relates to a construction of a contact element for the introduction of an electrical current into an electrical switch element, in which the contact element includes an electrical contact which is fastened in a contact holder of the switch element.

In order for an electrical switch element to have an optimum contact resistance, the special contact material has to be riveted or welded to the contact holder.

It is known to weld these contacts to the contact holder by resistance welding methods. Likewise it is state of the art to rivet contacts into a contact holder. These rivets can be pre-produced rivets, or can be present as a wire section for riveting.

The disadvantage of the method practiced up to now is that, particularly with thin support strips (e.g., 0.05 mm), the material thickness ratios differ greatly between the parts to be welded, which leads to poor welds and a variable manufacturing process. With contacts welded on both sides, this problem becomes even more severe.

When riveting contacts, a given value of riveting force is necessary to form the rivet such that the rivet holds stably in the bore, and a good electrical contact is present. Furthermore, a high quality contact surface has to be produced by the riveting pressure. Thin support strips are thereby deformed, so that a properly functioning part does not result.

The disadvantage furthermore exists that high quality coated contact surfaces can become damaged.

SUMMARY

The invention has as its object to provide a contact fastening which does not damage the previously produced contact surfaces. Moreover an optimum electrical connection must result. The contact support must not be deformed hereby.

Both single-sided and double-sided contacts can be made. A more stable manufacturing process, particularly when integrated into a multi-stage tool, has to be ensured.

The solution must in particular be suitable for very thin support strips (contact holders). It must be possible to use the usual contact materials.

The object is attained according to the invention by the contact element including an electrical contact which is fastened in a contact holder of the switch element, with the contact being inserted into a bore of the contact holder and being connected to the contact holder in regions of opposite overlaps.

Further features and advantages of the invention will become apparent from the dependent claims.

BRIEF DESCRIPTION OF THE DRAWINGS

Embodiments of the invention are shown in the drawing and are described in detail hereinafter.

DETAILED DESCRIPTION OF THE PREFERRED EMBODIMENTS

Figure 1:
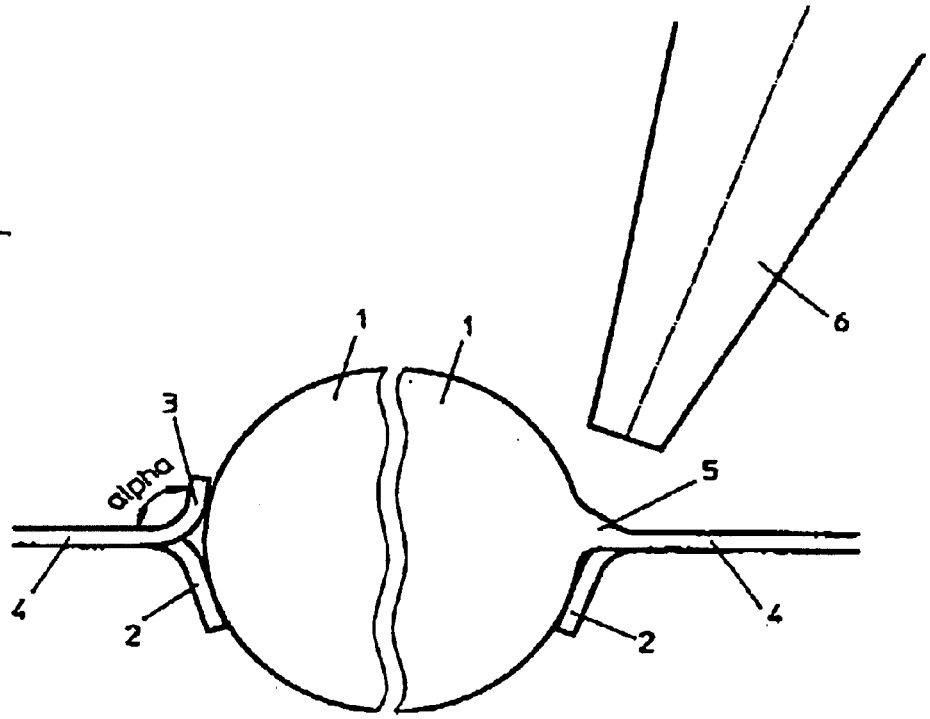
FIGS. 1 and 2 show one possible alternative embodiment of a spherical contact to be fastened by laser welding.

FIG. 1 shows, by way of example, a spherical contact 1, which is held by bent-down holding tabs 2. The welding tabs 3, bent upward on the opposite side, serve in this case to weld the ball 1 to the support strip material 4.

The left-hand sectional half shows the state before welding the portion 1 to the weld tab 3; and the right-hand half of the diagram shows the welded state 5 which has been produced by a laser beam, shown symbolically as (6).

The volume of welding material can be defined by the height of the welding tab 3 in order to obtain an optimum weld 5. The angle of bend "alpha" can be chosen so that the ball 1 snaps into the contact holder on assembly and is held between the tabs 2 and 3.

Figure 2:
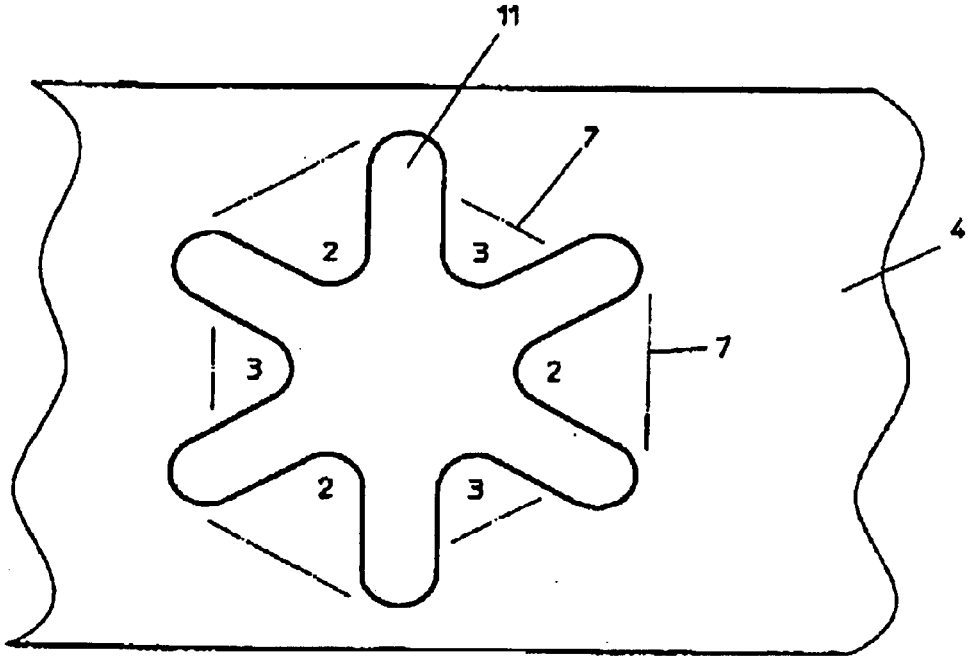

FIG. 2 shows the blank of the contact holder 4 and a bore 11 formed in the blank and serving for insertion of the contact 1, for which the tabs 2, 3 have to be bent out of the plane of the contact holder before or during insertion of the contact. The bend lines 7 at which the tabs are bent are shown symbolically. In this special case of use, the tabs 2 and 3 are arranged alternately and serve for optimum holding of the contact 1 with three each of bent up and bent down tabs. Embodiments are also conceivable with two each of the tabs 2 and 3.

The number and arrangement of the tabs also depends on the shape of the contact. For example, if a cylindrical contact 1*b* (not shown) is used, the arrangement of the tabs would logically correspond.

Figure 3:
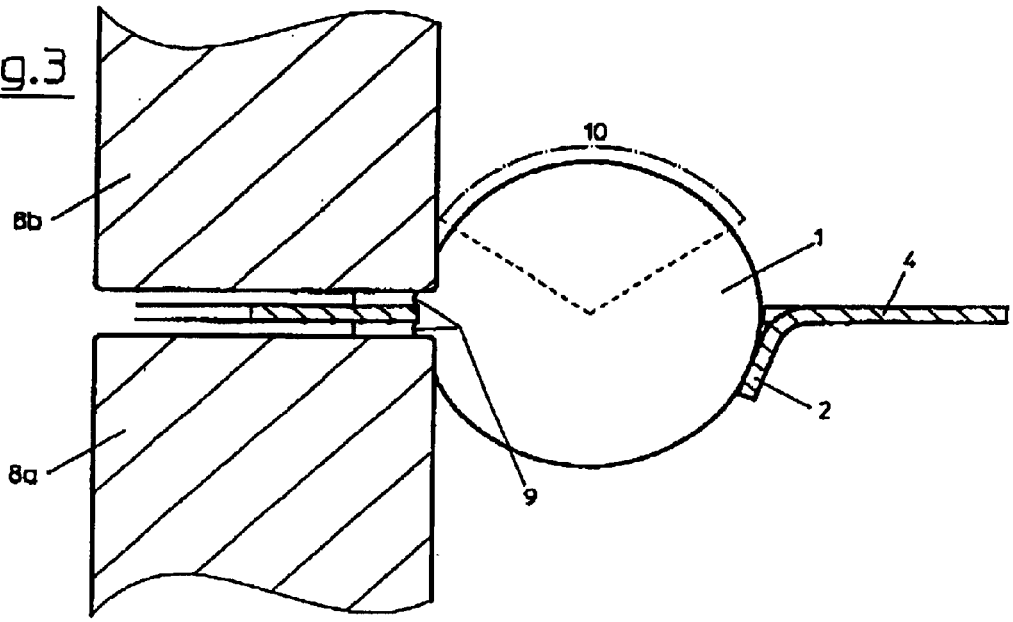
FIGS. 3 and 4 show a possible alternative embodiment of a spherical contact to be fixed to a contact holder by special holding tabs and by permanently fastening with a special stamping.

FIG. 3 shows, by way of example, a spherical contact 1 which in this case is held on one side downward in the contact holder by holding tabs 2, and is stamped in the interspaces at three places by two dies 8*a* and 8*b*, so that the contact overlaps the contact holder 4 in the region of these deformations 9 and is hereby held positively and frictionally.

The fact is decisive here that only short regions 9 of the contact holder 4 are concerned in the stamping. The contact holder 4 remains free from deformation, and the underside curve around the hole remains small. Moreover, the contact surface 10 of the contact 1 remains unaffected and is thus not damaged.

In order to obtain a good positioning of the contact 1 in the contact holder 4 and also a good fastening of the contact, it is recommended to stamp the contact 1 from both sides symmetrically toward the upper or lower side of the contact holder.

Figure 4:
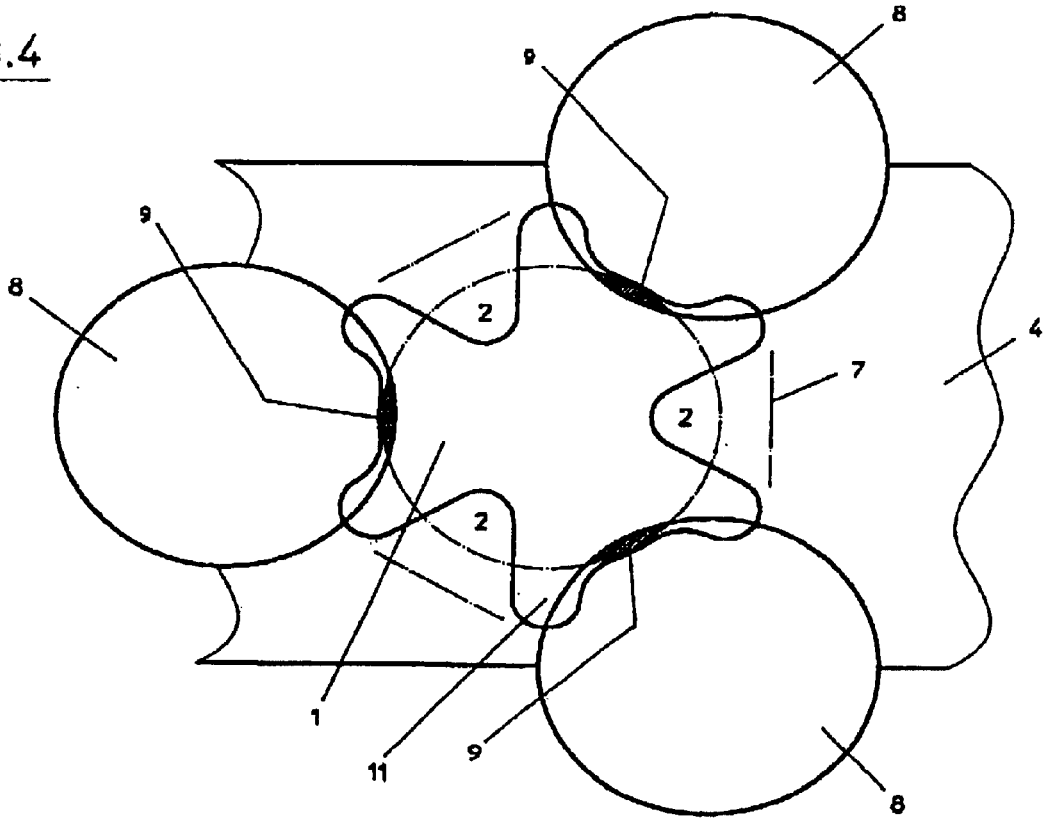

FIG. 4 shows the blank of the contact holder with the bore 11 and the bend lines 7. The spherical contact 1 is shown schematically with the stamping regions 9 dashed. In this example, three stamping regions over the periphery are shown.

Figure 5:
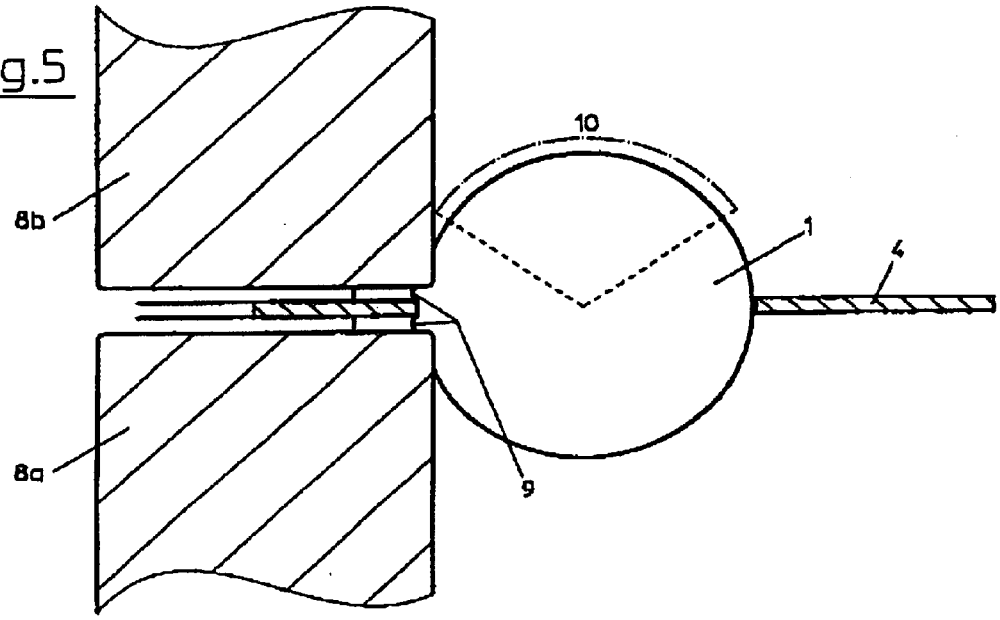
FIGS. 5 and 6 show the alternative embodiment of FIGS. 3 and 4, though without the use of holding tabs.
Figure 6:
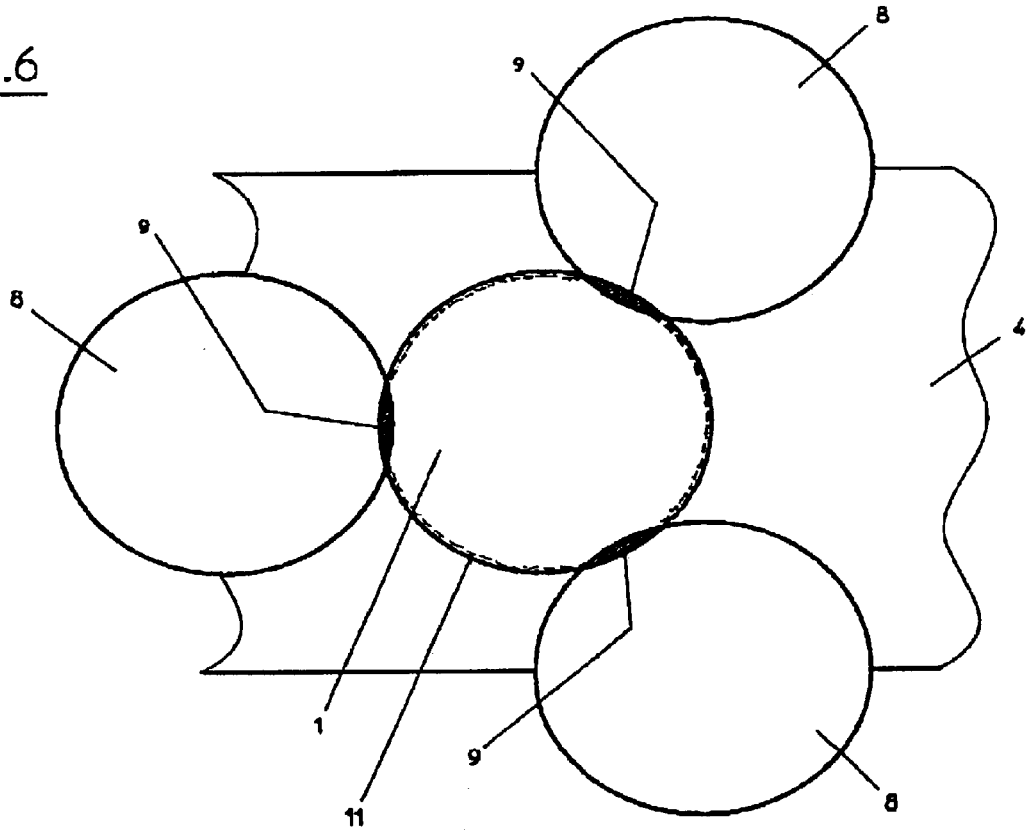

FIGS. 5 and 6 show an alternative embodiment similar to FIGS. 3 and 4, so that like components are identified with the same reference numerals. Only the holding tabs 2 are omitted in the constructional form of FIGS. 5 and 6, the contact 1 before stamping is not fixed in the contact holder 4. The blank of the contact holder accordingly has (corresponding to the cross section of the contact 1) a circular bore 11. By symmetrical action on the upper and lower side of the contact by the stamping die, and by the use of at least three pairs 8*a*, 8*b* of stamping dies uniformly distributed over the periphery, it can however be ensured that the contact 1 is fixed in the contact holder 4 in the middle of, and symmetrically of the plane of, the contact holder 4. In this embodiment example also, the regions 9 deformed during stamping form the overlapping of the contact 1 with the contact holder 4 by means of which the contact is held positively and frictionally.

The advantage of the invention is that the contact can be very easily mounted in the contact holder. Both the positioning and the fixing of the contact are ensured. The electrical connection can be produced by welding or stamping in the region of an opposite overlapping, thus ensuring that the support material is not deformed and the contact surface is not damaged.

What is claimed is:

1. Contact element for the introduction of an electrical current into an electrical switch element, the contact element comprising an electrical contact which is fastened in a contact holder of the switch element, wherein the contact (1) is inserted into a bore (11) of the contact holder (4) and is connected to the contact holder in regions of opposite overlaps (2-1, 3-1, 9-4).

2. Contact element according to claim 1, wherein the opposite overlaps (2-1, 3-1) are formed by tabs (2, 3) of the contact holder (4), opened out at least on one side.

3. Contact element according to claim 2, wherein the tabs (2, 3) extend over a partial region of the contact (1).

4. Contact element according to claim 2, wherein the contact (1) is connected to the contact holder (4) by laser welding in the regions of the opposite overlaps (3-1).

5. Contact element according to claim 1, wherein the contact is stamped with at least one tab.

6. Contact element according to claim 2, wherein the tabs (2, 3) are opened out alternately on each side of the contact holder.

7. Contact element according to claim 1, wherein the contact (1) is centered by a free punch in a bore (11) of the contact holder (4).

8. Contact element according to claim 2, wherein the contact is snapped into the tabs (2, 3).

9. Contact element according to claim 2, wherein at least two of the tabs (2, 3) are opened out on each side of the contact holder.

10. Contact element according to claim 1, wherein the overlaps (9-4) of the contact (1) and contact holder (4) are produced by opposite stamping of the contact.

11. Contact element according to claim 10, wherein the contact (1) is deformed on stamping such that the contact overlaps the contact holder (4) in partial regions (9).

12. Contact element according to claim 10, wherein the contact (1) is stamped toward each side of the contact holder (4).

13. Contact element according to claim 1, wherein the contact is formed as a sphere.

14. Contact element according to claim 1, wherein the contact has a cylindrical form.

15. Contact element according to claim 2, wherein one of the tabs used for holding (2) are longer than others of the tabs (3) to be welded.

16. Contact element according to claim 2, wherein the tabs (2, 3) are resilient and provide a mechanical damping on switching the contact (1).

* * * * *